US005899278A

United States Patent [19]

Mikulec

[11] Patent Number: 5,899,278

[45] Date of Patent: May 4, 1999

[54] STOVE TOP FIRE EXTINGUISHER SYSTEM

[76] Inventor: Richard A. Mikulec, 33 Clarkes Crossing, Fairport, N.Y. 14450

[21] Appl. No.: 08/795,935

[22] Filed: Feb. 5, 1997

[51] Int. Cl.[6] ..... A62C 3/00

[52] U.S. Cl. ..... 169/65

[58] Field of Search ..... 169/65, 60, 26, 169/DIG. 3

[56] References Cited

U.S. PATENT DOCUMENTS 4,979,572 12/1990 Mikulec ..... 169/65

*Primary Examiner*—Andrew C. Pike
*Attorney, Agent, or Firm*—Robert J. Bird

[57] ABSTRACT

A stove-hood fire extinguisher system includes a reservoir for fire extinguishing agent, and a distributor arm which in turn includes a fluid tube and an actuator tube. An extinguisher valve connects the reservoir to the fluid tube, and includes a valve stem extending into the actuator tube. A fuse mechanism on the distributor arm includes a fuse element, a movable trigger extending from the fuse element into the actuator tube, and a tightener to press the fuse element against the trigger. An actuator mechanism in the actuator tube includes an actuator rod with a detent block on one end for engagement with the trigger and a ramp on the other end for engagement with the valve stem, and a compression spring urging the ramp toward the valve stem. The trigger extending into the detent groove holds the actuator rod in a retracted position. Rupture of the fuse element releases the trigger from the detent groove, and the spring drives the actuator rod and ramp against the valve stem to open the extinguisher valve.

3 Claims, 2 Drawing Sheets

STOVE TOP FIRE EXTINGUISHER SYSTEM

This invention is a self-contained automatic stove top fire extinguisher system, adapted for mounting in a stove hood.

BACKGROUND AND INFORMATION DISCLOSURE STATEMENT

Various automatic extinguishing devices for stove top fires are known in the prior art. Prior art that I know of is as follows:

U.S. Pat. No. 4,256,181 issued Mar. 17, 1981 to Searcy

U.S. Pat. No. 4,813,487 issued Mar. 21, 1989 to Mikulec et al.

U.S. Pat. No. 4,979,572 issued Dec. 25, 1990 to Mikulec

U.S. Pat. No. 5,297,636 issued Mar. 29, 1994 to North

U.S. Pat. No. 5,351,760 issued Oct. 4, 1994 to Tabor, Ar.

These patents all disclose hood-mounted fire extinguishers for stove fires. Each of them includes an exposed tension cable extending across the open bottom of the hood, over a stove top. The tension cable is connected to a fire extinguisher valve, holding the valve closed. The cable includes fusible links. In the event of a stove top fire, the resulting melting of a link breaks the tension cable to open the fire extinguisher valve. The exposed cable is unsightly, and it becomes more so as it accumulates a coating of grease from stove is that homeowners occasionally use the cable as a convenient line from which to hang small articles of wet laundry. Careless removal of such items from the tension cable can then trigger the valve mechanism with unfortunate results.

SUMMARY OF THE INVENTION

A stove-hood fire extinguisher of this invention includes a reservoir for fire extinguishing agent, and a distributor arm with a fluid tube and an actuator tube. An extinguisher valve connects the reservoir to the fluid tube, and includes a valve stem extending into the actuator tube. A fuse mechanism on the distributor arm includes a fuse element and a trigger. An actuator mechanism in the actuator tube includes an actuator rod with a detent block on one end to engage the trigger, a ramp on the other end to engage the valve stem, and a compression spring urging the ramp toward the valve stem. The trigger normally engages the detent block to hold the actuator rod in a retracted position. Rupture of the fuse element releases the trigger from the detent groove, and the compression spring drives the actuator rod and ramp against the valve stem to open the extinguisher valve.

DESCRIPTION OF PREFERRED EMBODIMENT

Figure 1:
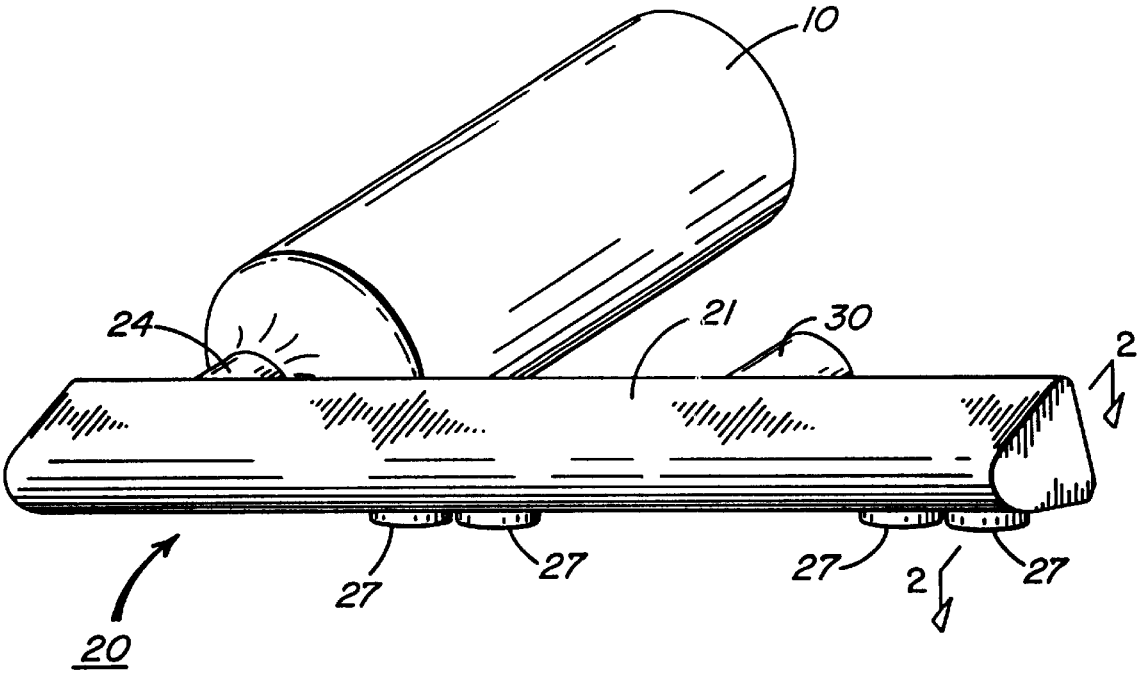
FIG. 1 is a pictorial view of a fire extinguisher system according to this invention, including a fluid reservoir and a distributor arm.

FIG. 1 shows a fire extinguisher system, including a fluid reservoir 10 containing a fluid fire extinguishing agent under pressure, and a horizontal distributor arm 20. The system is adapted to be mounted in the underside of a stove hood, not shown.

Figure 2:
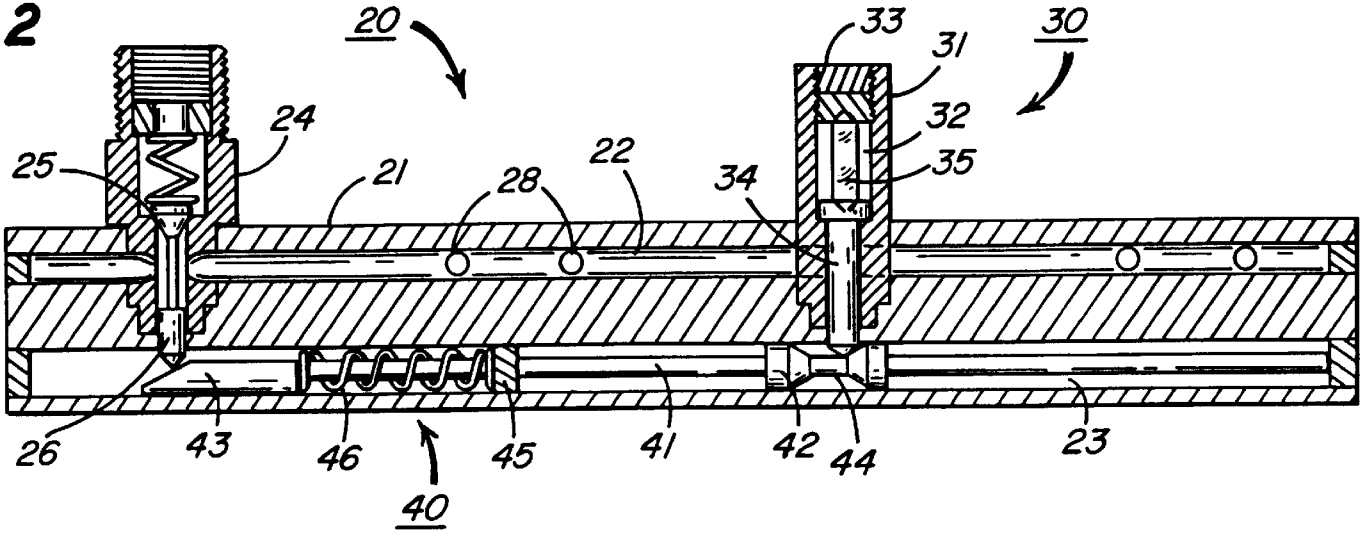
FIG. 2 is a sectional plan view on the plane 2—2 of FIG. 1 of the distributor arm, showing the system armed and ready for operation.
Figure 3:
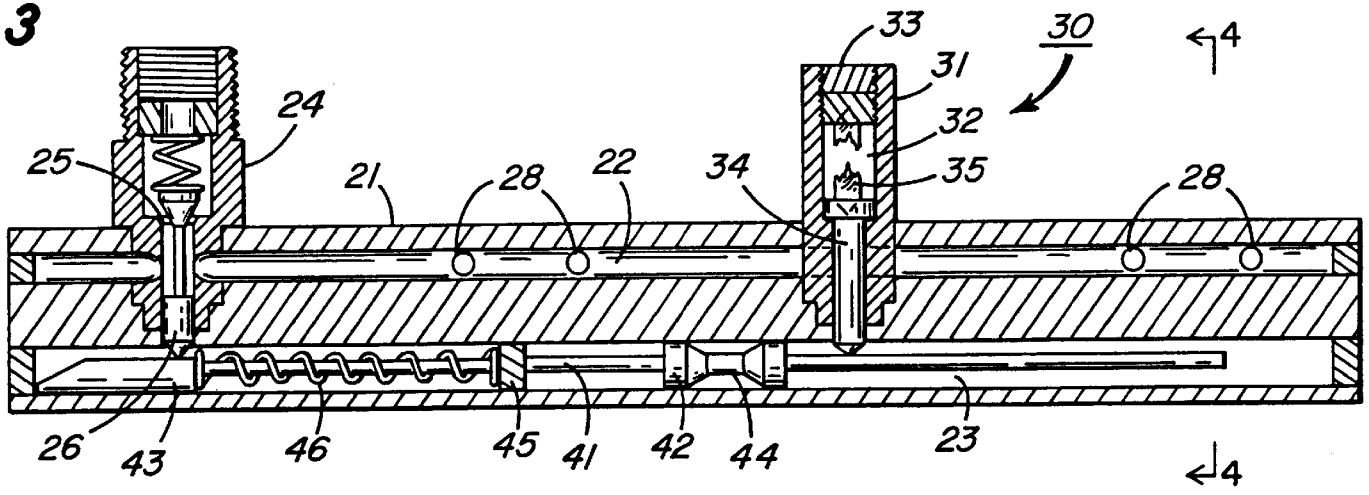
FIG. 3 is a similar view, showing the system in its actuated condition.

Referring now to FIGS. 2 and 3, the distributor arm 20 includes an elongated body 21 supporting a fluid tube 22 and an actuator tube 23 along its length. An extinguisher valve 24 is connected to the reservoir 10 and to the body 21 of the distributor arm 20 near one end thereof. The valve 24 includes a normally closed valve port 25 leading into the fluid tube 22, and an axially movable valve stem 26. The valve stem 26 extends from the body of the valve 24 transversely into the actuator tube 23. The valve 24 is closed in FIG. 2.

Figure 4:
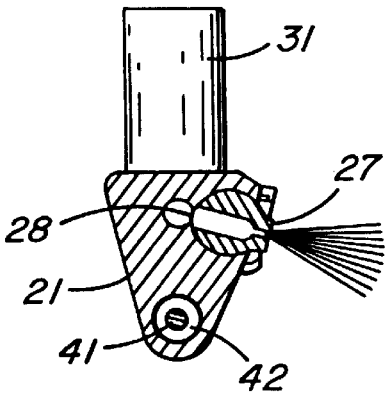
FIG. 4 is a sectional view on the plane 4—4 of FIG. 3.

The fluid tube 22 in the distributor arm 20 includes outlets 28 along its length, and a spray nozzle 27 extends from each outlet 28. The spray nozzles 27 are ball-mounted and individually pivotable so that each is directed at one of the burners on the stove top. See also FIG. 4.

A fuse mechanism 30 is mounted to the distributor arm 20 at a central location so as to be generally centered over the stove burners when the system is mounted in a hood. The fuse mechanism 30 includes a fuse body 31, a threaded fuse cavity 32 in one end of the fuse body, a screw cap 33 threaded into the fuse cavity 32, and a movable trigger 34. The trigger 34 extends axially within the fuse body 31, from the bottom of the fuse cavity 32 and transversely into the actuator tube 23 (the axis of the fuse body 31 is transverse to the axis of the actuator tube 23). A glass bulb or "fuse" 35 is placed in the fuse cavity 32. The screw cap 33 is threaded against the glass bulb 35 to hold it firmly in place. The glass bulb 35, in turn, bears on the trigger 34 to keep it protruding into the actuator tube 23.

An actuator mechanism 40 within the actuator tube 23 includes an actuator rod 41 with a detent block 42 on one end and a cam or ramp 43 on the other end. The actuator rod 41, detent block 42, and ramp 43 are together axially movable within the actuator tube 23. The detent block 42 includes a detent groove 44. The trigger 34 extends from the fuse body 31 into the detent groove 44 of the detent block 42, holding the detent block 42 and actuator rod 41 in the armed position shown in FIG. 2. A stationary stop member 45 is mounted within the actuator tube 23. A compression spring 46 surrounds the actuator rod 41 between the ramp 43 and the stationary spring stop 45.

In FIG. 2 the actuator rod 41 is held in the armed position by the detent mechanism (i.e., trigger 34 extending into detent groove 44), the spring 46 is in compression, and the ramp 43 on the actuator rod 41 does not quite engage the valve stem 26 of the extinguisher valve 24.

FIG. 3 shows the system actuated and in operation. A stove fire has just ruptured the glass bulb 35 in the fuse mechanism 30. Rupture of the glass bulb 35 releases the trigger 34 from the detent groove 44 in the detent block 42. The compression spring 46 drives the actuator rod 41 to the left, and the ramp 43 operates against the valve stem 26 to open the extinguisher valve 24, discharging extinguishing agent through the spray nozzles 27.

The glass bulb 35 is the preferred heat-responsive trigger for this system. These devices are well known. They contain liquid. They operate, not by melting or fusing, but by rupture from pressure of the contained liquid. The term "fuse" therefore does not, strictly speaking, describe the action. "Fuse mechanism", "fuse element", "fuse body", and "fuse cavity" are used herein nevertheless for convenience to identify those respective components.

The foregoing description of a preferred embodiment of this invention, including any dimensions, angles, or proportions, is intended as illustrative. The concept and scope of the invention are limited only by the following claims and equivalents thereof.

What is claimed is:

1. A fire extinguisher system for mounting in a stove hood, said system including a reservoir of fire extinguishing agent, and a distributor arm operatively connected to said reservoir, said distributor arm including:

a fluid tube;

a valve actuator;

an extinguisher valve operatively connected to said reservoir and to said fluid tube, said valve including a valve stem to engage said actuator; and a fuse mechanism including a fuse element, a movable trigger extending from said fuse element to said valve actuator, and means to press said fuse element against said trigger;

said valve actuator including an actuator rod with a detent block on one end for engagement with said trigger and a ramp on another end for engagement with said valve stem, and a compression spring urging said ramp toward said valve stem.

2. A fire extinguisher system for mounting in a stove hood, said system including a reservoir of fire extinguishing agent, and a distributor arm operatively connected to said reservoir, said distributor arm including:

a fluid tube;

an actuator tube;

an extinguisher valve operatively connected to said reservoir and to said fluid tube, said valve including a valve stem extending into said actuator tube;

a fuse mechanism including a fuse element, a movable trigger extending from said fuse element into said actuator tube, and means to press said fuse element against said trigger; and an actuator mechanism disposed in said actuator tube, including an actuator rod with a detent block on one end for engagement with said trigger and a ramp on another end for engagement with said valve stem, and a compression spring urging said ramp toward said valve stem.

3. A fire extinguisher system for mounting in a stove hood, said system including a reservoir of fire extinguishing agent, and a distributor arm operatively connected to said reservoir, said distributor arm including:

a fluid tube with a nozzle extending therefrom;

an actuator tube;

an extinguisher valve operatively connected to said reservoir and to said fluid tube, said valve including a valve stem extending into said actuator tube;

a fuse mechanism including a glass bulb, a movable trigger extending from said glass bulb transversely into said actuator tube, and means to press said glass bulb against said trigger; and an axially movable actuator mechanism disposed in said actuator tube, including an actuator rod with a detent block and a ramp on opposite ends thereof, said detent block being adapted for engagement with said trigger, said ramp being adapted for engagement with said valve stem, and a compression spring urging said ramp toward said valve stem;

wherein rupture of said glass bulb releases said trigger from said detent block, permitting said compression spring to drive said ramp against said valve stem to open said extinguisher valve.

* * * * *